US011059637B2

(12) United States Patent
Roto

(10) Patent No.: US 11,059,637 B2
(45) Date of Patent: Jul. 13, 2021

(54) CHILD RESISTANT CONTAINER SYSTEM

(71) Applicant: Leigh Roto, Des Plaines, IL (US)

(72) Inventor: Leigh Roto, Des Plaines, IL (US)

( * ) Notice: Subject to any disclaimer, the term of this patent is extended or adjusted under 35 U.S.C. 154(b) by 206 days.

(21) Appl. No.: 16/362,200

(22) Filed: Mar. 22, 2019

(65) Prior Publication Data

US 2019/0337688 A1 Nov. 7, 2019

Related U.S. Application Data

(60) Provisional application No. 62/666,202, filed on May 3, 2018.

(51) Int. Cl.
*B65D 50/04* (2006.01)

(52) U.S. Cl.
CPC ..... *B65D 50/041* (2013.01)

(58) Field of Classification Search
CPC ..... B65D 50/041
USPC ..... 215/220
See application file for complete search history.

(56) References Cited

U.S. PATENT DOCUMENTS 2,061,214 A * 11/1936 Sentman ..... B65D 50/041 215/220
2,980,274 A * 4/1961 Gould ..... B65D 50/041 215/220
3,472,410 A * 10/1969 Turner ..... B65D 50/041 215/206
4,241,840 A * 12/1980 Willis ..... B65D 50/041 215/220
4,729,487 A * 3/1988 Wright ..... B65D 50/041 215/219
4,832,218 A * 5/1989 Gibilisco ..... B65D 50/041 215/219
5,588,545 A * 12/1996 King ..... B65D 41/0414 215/216
2004/0045923 A1* 3/2004 Lancesseur ..... B65D 50/041 215/220
2009/0301990 A1* 12/2009 Cresswell ..... A45F 3/18 215/344

* cited by examiner

*Primary Examiner* — James N Smalley
(74) *Attorney, Agent, or Firm* — Leavitt Eldredge Law Firm

(57) ABSTRACT

A child restraint container system has a hollow body elongated from a closed end to an open end and a cap that fits over the open end to seal the container. The cap is formed from a top portion and a bottom portion, each portion having a disc. Each disc has at least one ring of teeth configured to engage the teeth of the other disc. The interlocking disc allow the container to be sealed such that a child would be unable to remove the cap and open the container.

5 Claims, 10 Drawing Sheets

CHILD RESISTANT CONTAINER SYSTEM

BACKGROUND

1. Field of the Invention

The present invention relates generally to child restraint container systems, and more specifically, to a child restraint container system for use in steel and aluminum containers.

2. Description of Related Art

Child restraint container systems are well known in the art and are effective means to prevent a child from accessing the contents of the container. For example, FIG. 1 depicts a conventional child restraint container system 101 having fasteners around the outer rim. During use, the fasteners secure the lid of the container to prevent a child from opening the container.

One of the problems commonly associated with system 101 is it is made entirely from plastic and isn't as durable as an aluminum or steel container.

Accordingly, although great strides have been made in the area of child restraint containers, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
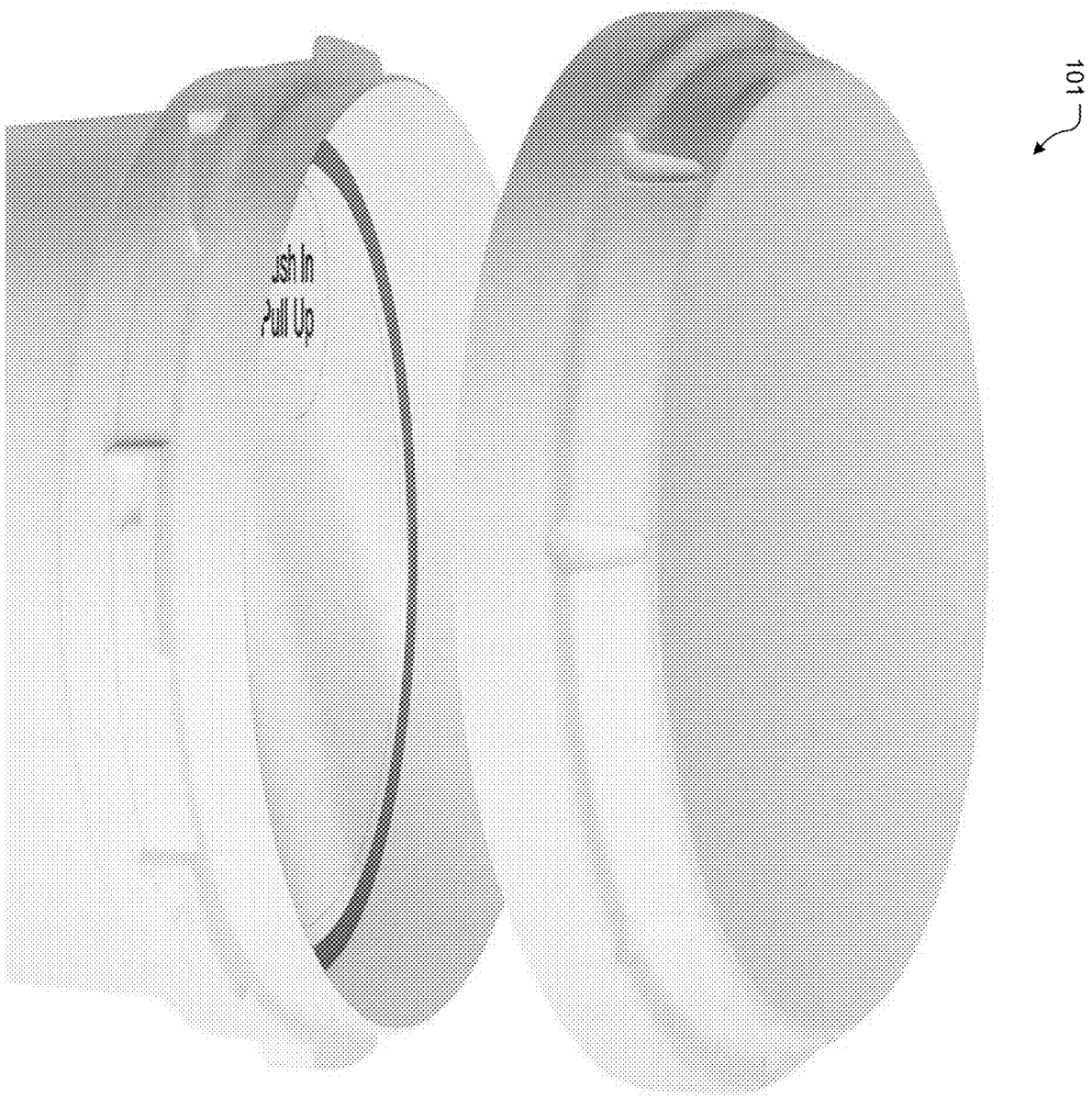
FIG. 1 (Prior Art)
FIG. 1 shows a common child restraint system.

While the system of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system in accordance with the present application overcomes one or more of the above-discussed problems commonly associated with conventional child restraint systems. Specifically, the system may be made of aluminum, steel, or another durable material to increase strength, security, and durability of the system. These and other unique features of the system are discussed below and illustrated in the accompanying drawings.

The system will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
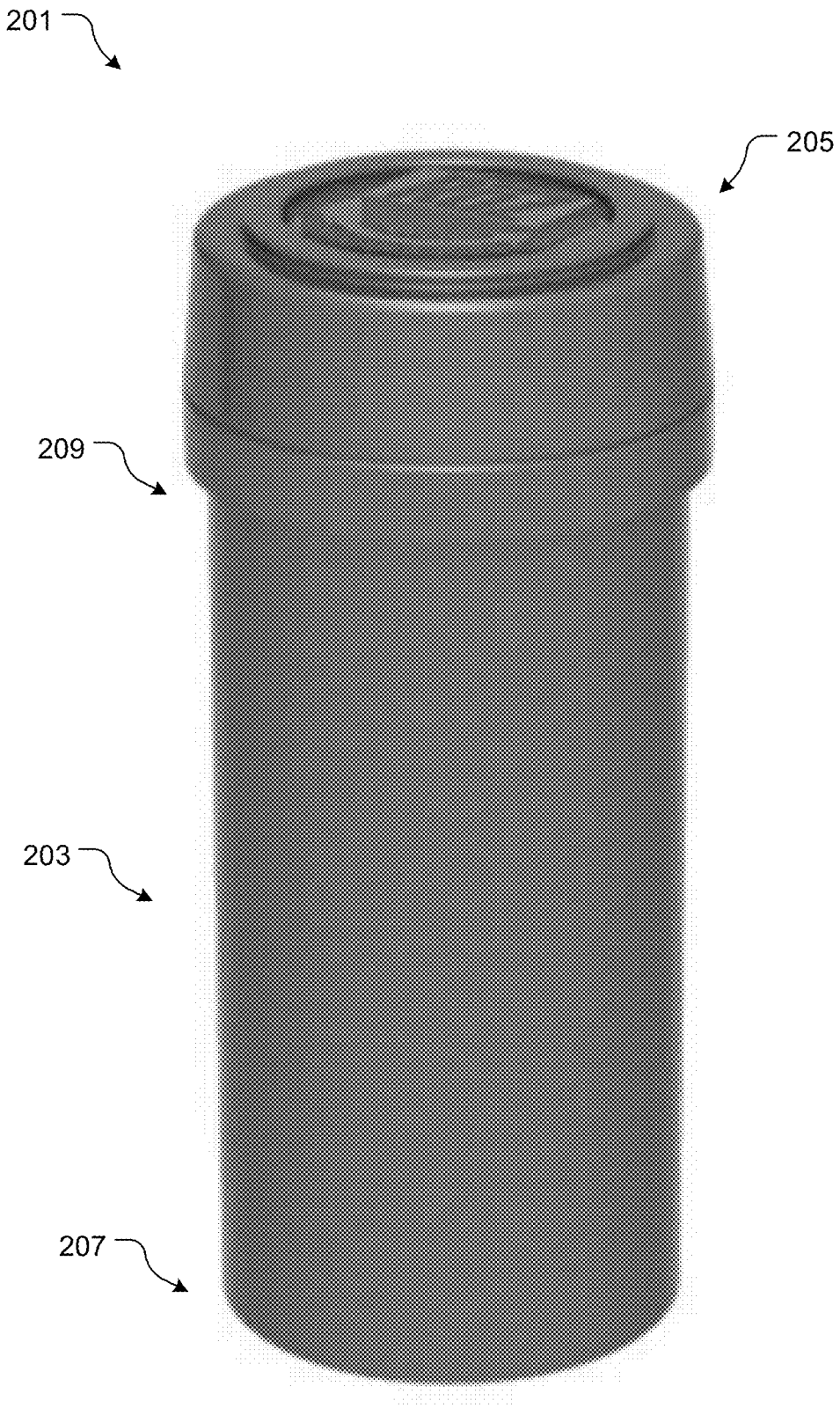
FIG. 2 shows a common child restraint system in accordance with a preferred embodiment of the present application.

Referring now to the drawings wherein like reference characters identify corresponding or similar elements throughout the several views, FIG. 2 depicts a child restraint system in accordance with a preferred embodiment of the present application. It will be appreciated that system 201 overcomes one or more of the above-listed problems commonly associated with conventional child restraint systems.

In the contemplated embodiment, system 201 includes an elongated hollow body 203 having a closed end 207 and an open end 209, and a cap 205 fitting over the open end 209.

Figure 3:
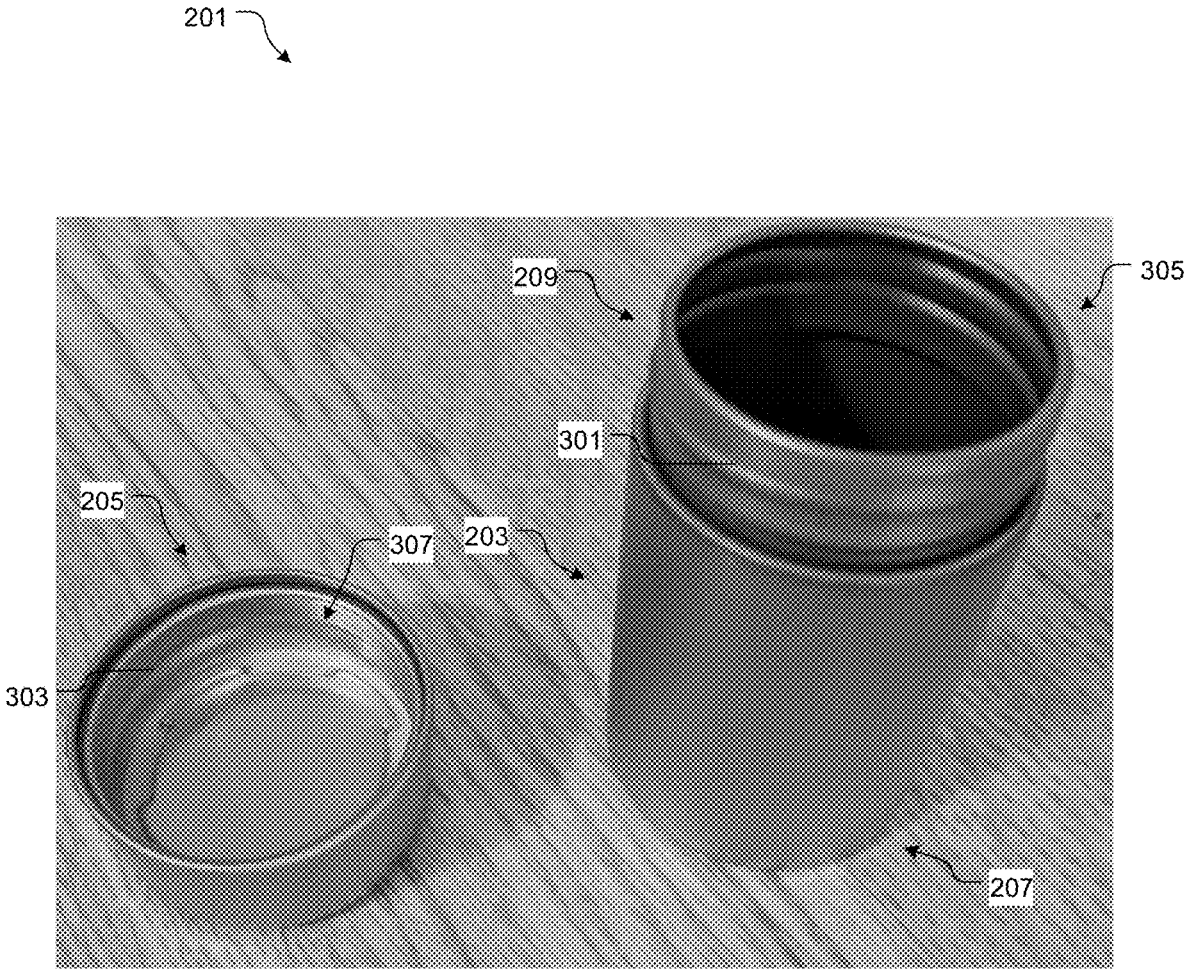
FIG. 3 shows the child restraint system with a cap removed.

FIG. 3 shows system 201 with the cap 205 removed. The open end 209 has threading 301 wrapping around an outer perimeter 305 of the open end 209. The cap 205 also has threading 303 wrapping around an inner perimeter 307 and configured to engage with the threading 305 and seal the child restraint container system 201.

Figure 4:
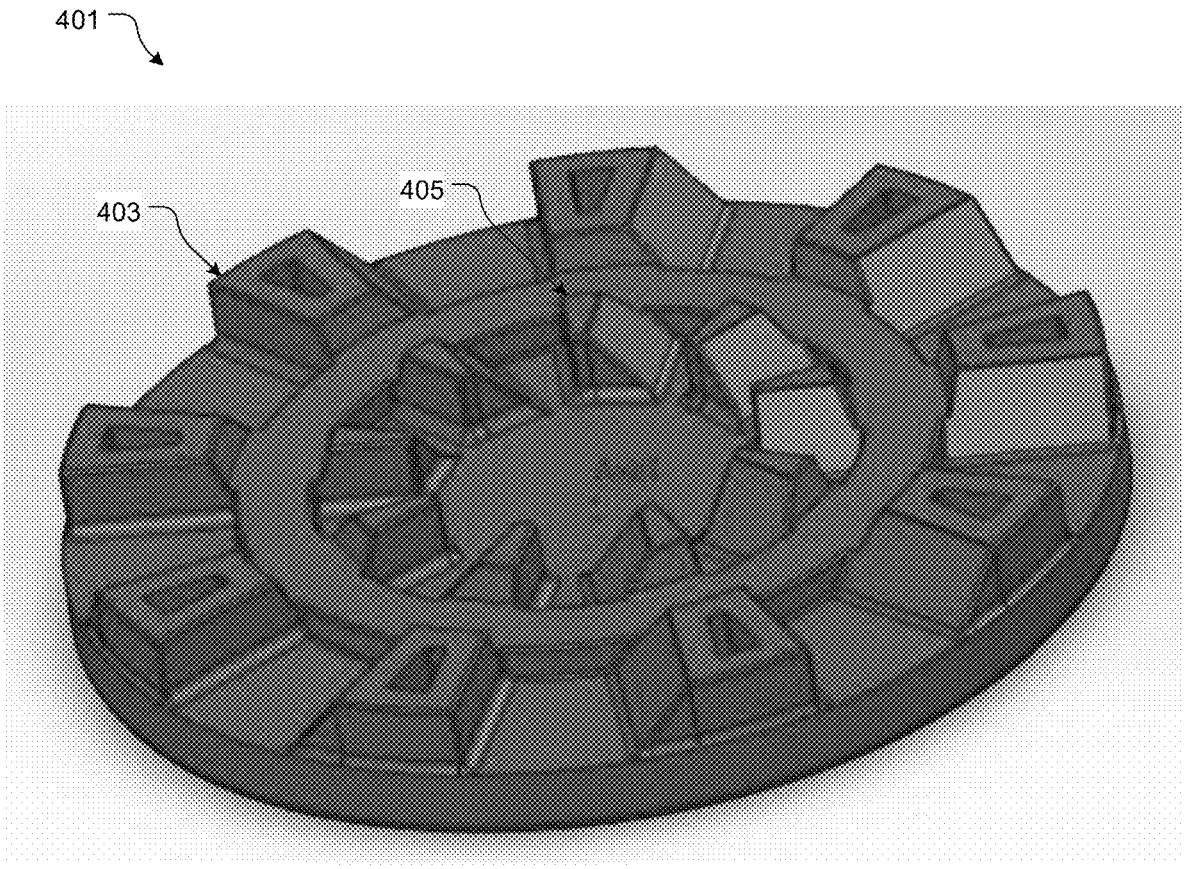
FIG. 4 shows a disc.

FIG. 4 shows a disc 401 having a ring of teeth 403 configured to engage the ring of teeth 403 of another disc 401. A disc 401 may also have an additional ring of teeth 405 configured to engage an additional ring of teeth 405 of another disc 401. System 201 has two discs 401, a top disc 401 and a bottom disc 401.

Figure 5:
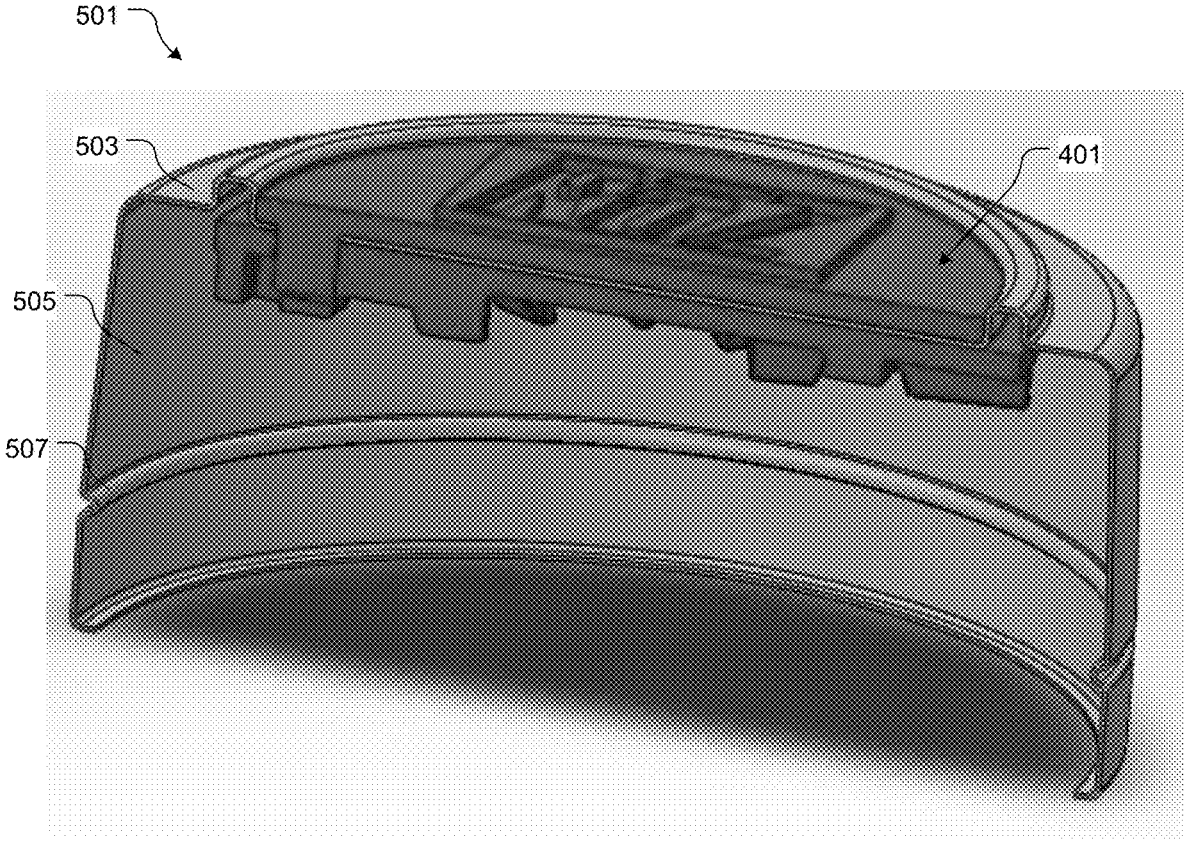
FIG. 5 is a cross-sectional view of a top portion of the cap.
Figure 6:
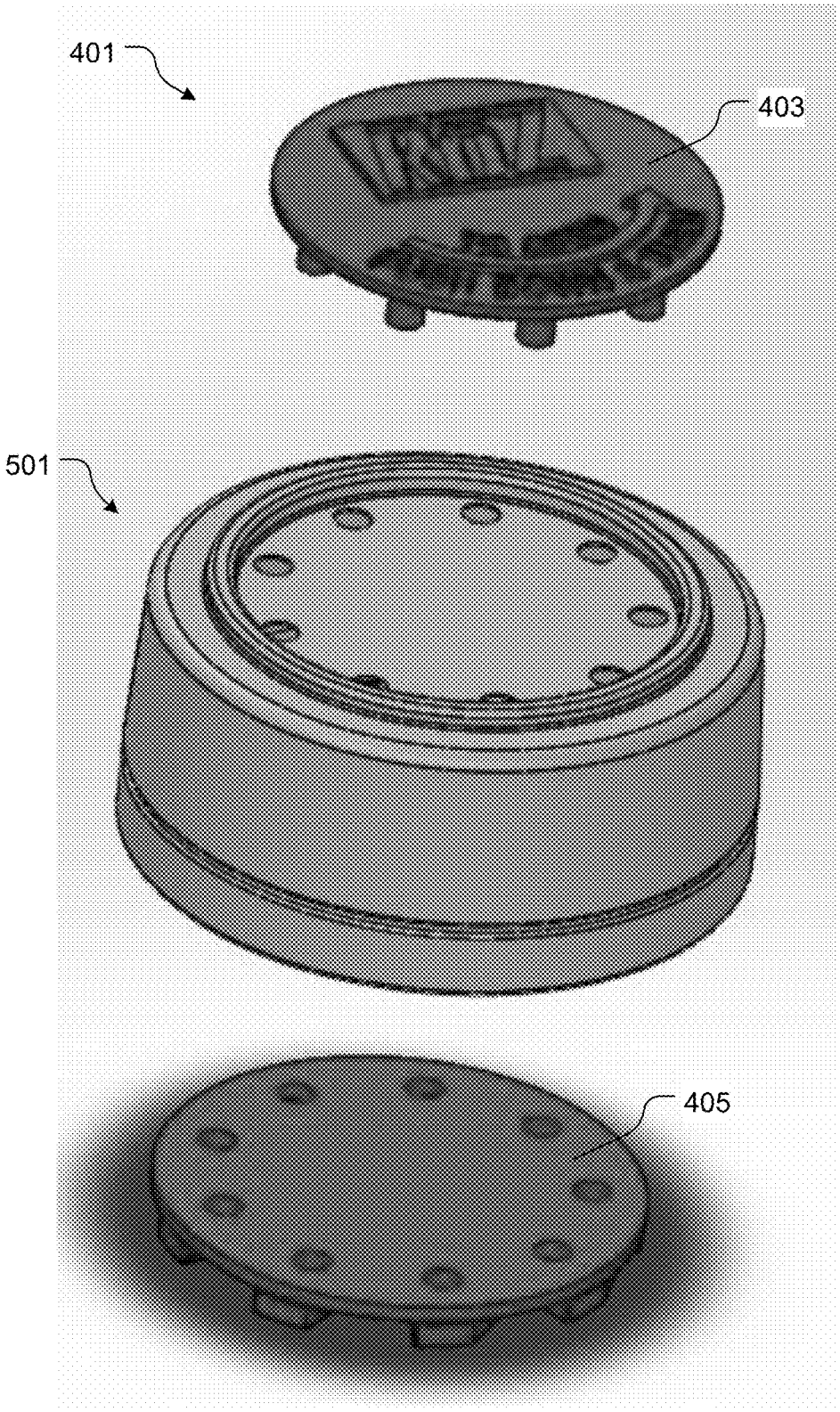
FIG. 6 shows an upper piece and a lower piece of a top disc assembled to the top portion of the cap.

FIG. 5 shows a top portion 501 of the cap 205. The top portion 501 has an outer surface 503 and an inner surface 505. The top disc 401 is assembled to the top portion 501. The top portion 501 may also have a groove 507. The top disc 401 may comprise an upper piece 403 contacting the outer surface 503 and a lower piece 405 contacting the inner surface 505 of the top portion 501. The upper piece 403 and the lower piece 405 connect to form the top disc 401 with the top portion sandwiched between the upper piece 403 and the lower piece 405 as shown in FIG. 6.

Figure 7:
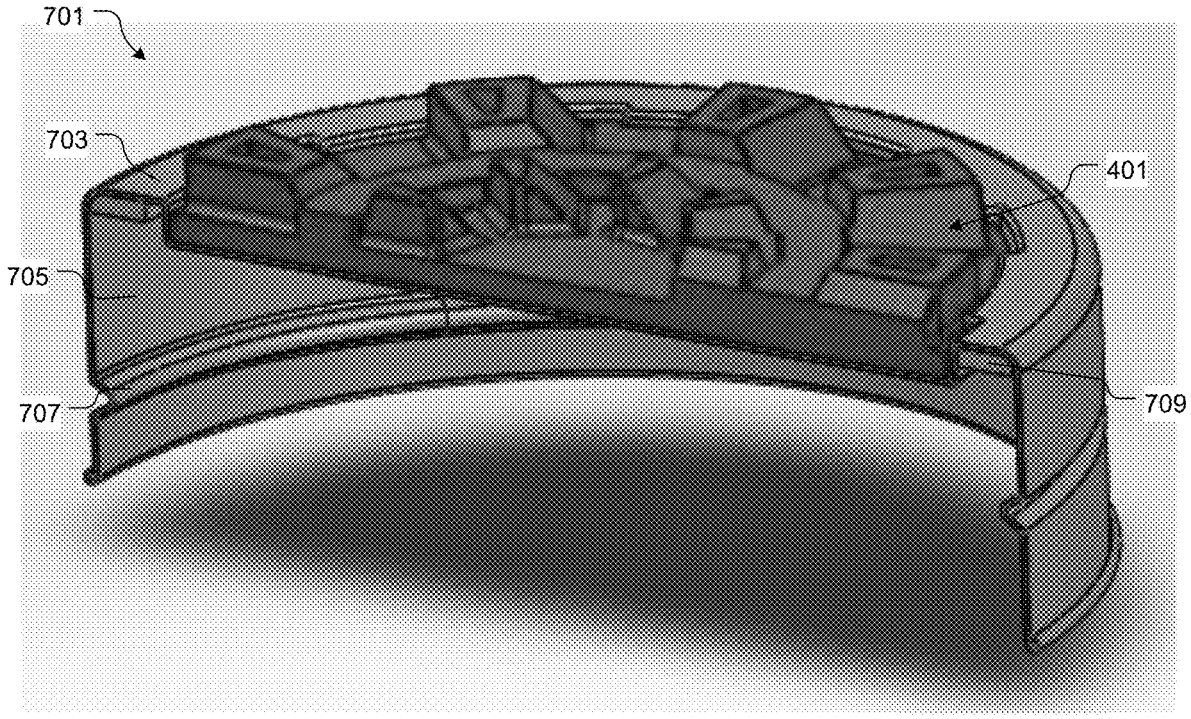
FIG. 7 is a cross-sectional view of a bottom portion of the cap.
Figure 8:
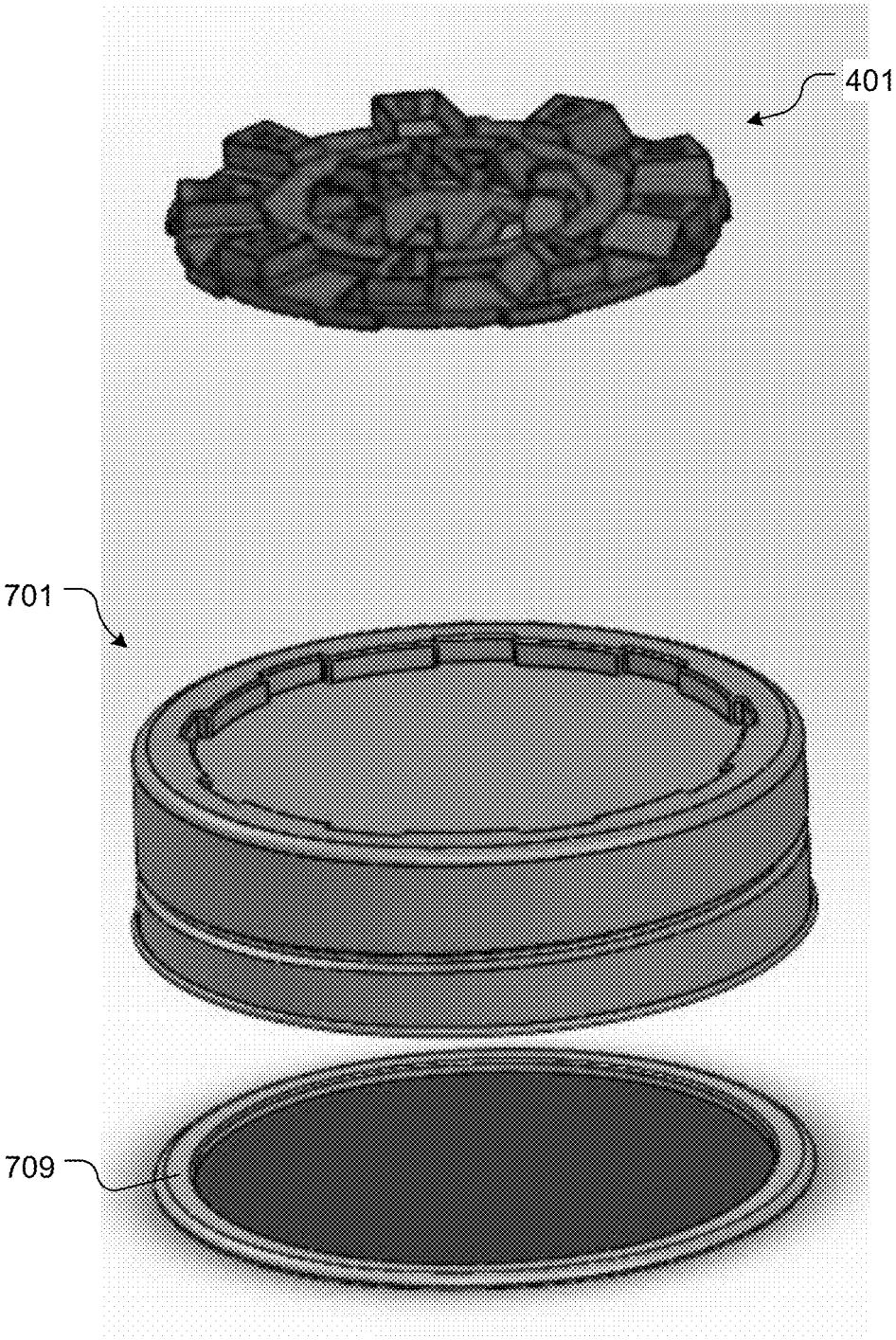
FIG. 8 shows a bottom disc assembled to the bottom portion of the cap and a ring seal disposed along an inner surface of the bottom portion.

FIG. 7 shows a bottom portion 701 of the cap 205. The bottom portion 701 has an outer surface 703 and an inner surface 705. The bottom disc 401 is assembled to the bottom portion 701. The bottom portion 701 may also have a groove 707 configured to engage the groove 507 of the top portion 501. The bottom portion 701 may also have a ring seal 709 disposed along the inner surface 705. FIG. 8 shows the bottom disc 401, the bottom portion 701 and the ring seal 709 fitting together.

Figure 9:
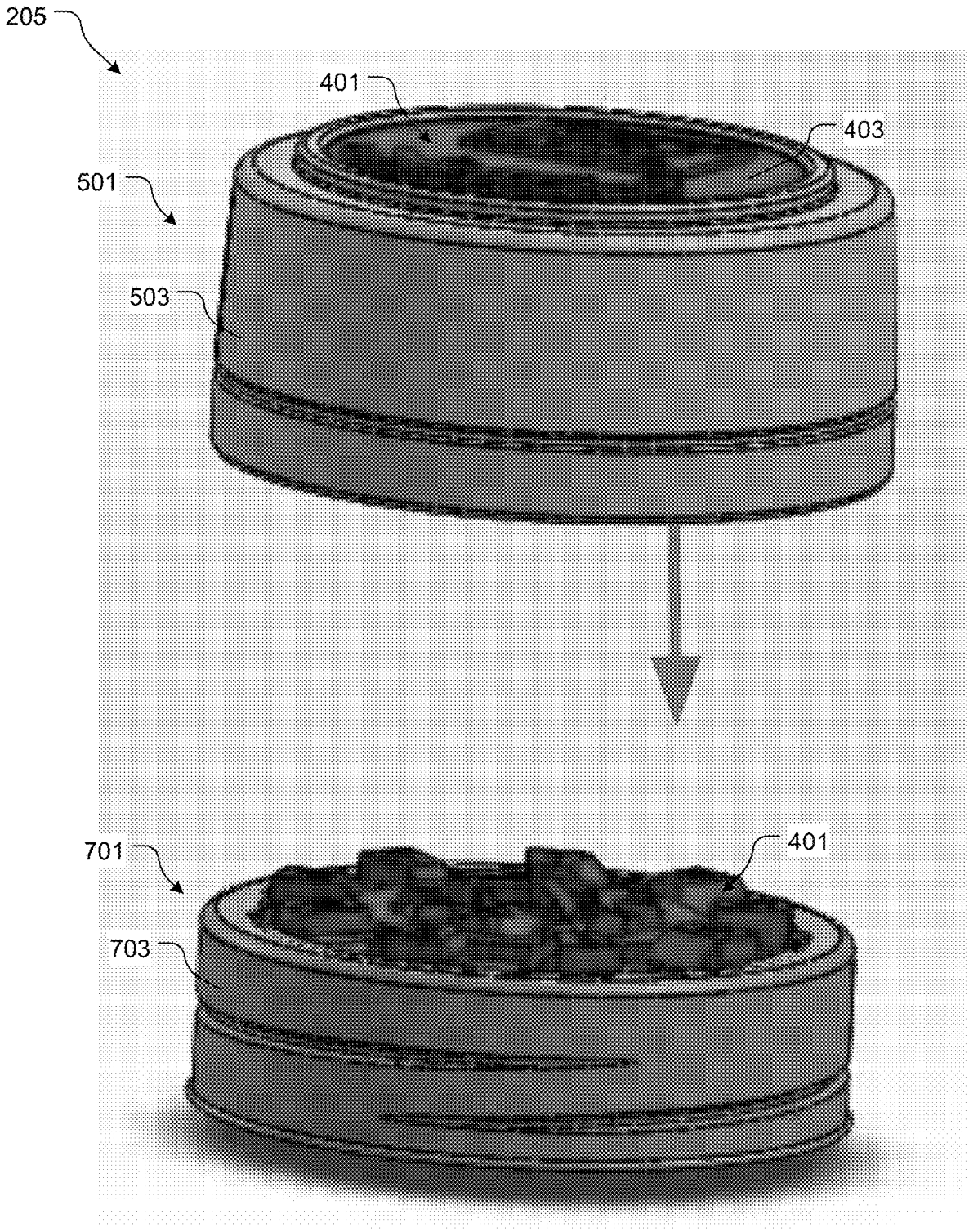
FIG. 9 shows the top portion fitting over the bottom portion forming the cap.
Figure 10:
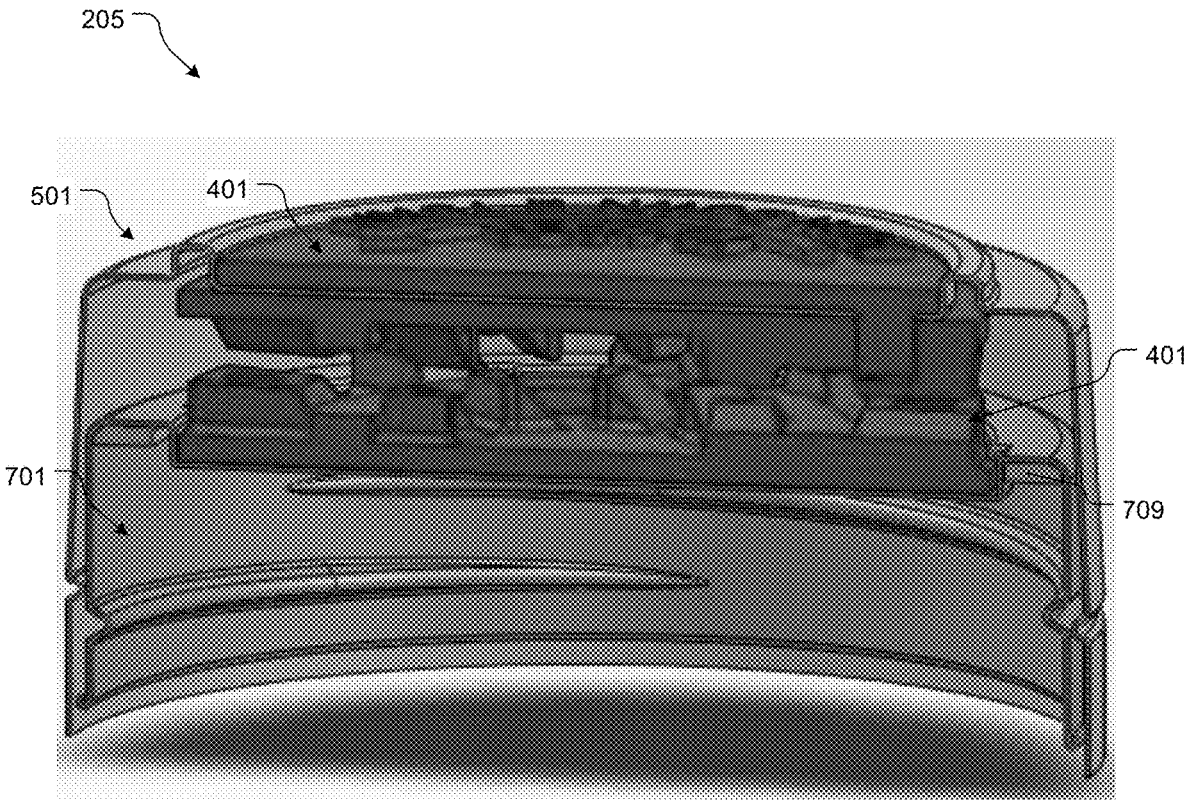
FIG. 10 is a cross-sectional view of the cap.

FIG. 9 shows the top portion 501 fitting over the bottom portion 701 such that the inner surface 505 of the top portion 501 contacts the outer surface 703 of the bottom portion 701, forming the cap 205 as shown in FIG. 10.

The child container system 201 provides one or more of the following features: (1) the construction enables reuse of the container, (2) limits access to the container to a person having cognitive skill to perform multiple simultaneous actions, and (3) enables the use of non-plastic materials in the construction of the container system 201.

In a preferred embodiment, the container system 201 may be made of a metallic material such as aluminum or steel. However, it is contemplated having different types of materials such as plastic, composite, and the like to manufacture the container system 201. Further, the process of manufacturing may include stamp, injection molding, 3D printing, and the like.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A child restraint container system, comprising:

a hollow body elongated from a closed end to an open end, the open end having threading wrapping around an outer perimeter;

a cap fitting over the open end of the hollow body and comprising:

a top portion having a skirt integral with a top wall forming the top portion;

a top disc having an upper piece and a lower piece and one or more rings of teeth, the top disc secured to the top wall of the top portion;

a bottom portion having a skirt integral with a top wall and an inner surface having threading wrapping around an inner perimeter and configured to engage the threading of the open end of the hollow body;

a bottom disc disposed within a recess within the top wall of the bottom portion, the bottom disc having one or more rings of teeth;

wherein the top portion fits over the bottom portion such that skirt of the top portion surrounds the skirt of the bottom portion; and wherein the top disc engages with the bottom disc via the one or more rings of teeth of the top disc and the one or more rings of teeth of the bottom disc.

2. The child restraint container system of claim 1, further comprising a ring seal disposed along the inner surface of the bottom portion of the cap and forming a seal between the hollow body and the cap.

3. The child restraint container system of claim 1, wherein the ring seal is made of silicone.

4. The child restraint container system of claim 1, wherein the top portion of the cap has a groove and the bottom portion of the cap has a groove configured to engage the groove of the top portion of the cap.

5. The child restraint container system of claim 1, wherein the system is made of aluminum and steel.

* * * * *